US008435061B2

(12) United States Patent
Ijima

(10) Patent No.: US 8,435,061 B2
(45) Date of Patent: May 7, 2013

(54) CONNECTOR

(75) Inventor: Norihumi Ijima, Kawasaki (JP)

(73) Assignee: Ijimaseiki Co., Ltd., Kawasaki-shi, Kanagawa (JP)

( * ) Notice: Subject to any disclaimer, the term of this patent is extended or adjusted under 35 U.S.C. 154(b) by 122 days.

(21) Appl. No.: 12/736,737

(22) PCT Filed: May 1, 2009

(86) PCT No.: PCT/JP2009/058556

§ 371 (c)(1),
(2), (4) Date: Aug. 16, 2011

(87) PCT Pub. No.: WO2009/139309

PCT Pub. Date: Nov. 19, 2009

(65) Prior Publication Data

US 2011/0294331 A1 Dec. 1, 2011

(30) Foreign Application Priority Data

May 10, 2008 (JP) ..... 2008-124106

(51) Int. Cl.
*H01R 4/50* (2006.01)

(52) U.S. Cl.
USPC ..... 439/348; 439/319

(58) Field of Classification Search ..... 439/345, 439/347, 348, 319
See application file for complete search history.

(56) References Cited

U.S. PATENT DOCUMENTS 3,678,439 A * 7/1972 Vetter ..... 439/253
4,582,347 A * 4/1986 Wilcox et al. ..... 285/12
5,690,503 A * 11/1997 Konda et al. ..... 439/348
5,702,264 A * 12/1997 Endo et al. ..... 439/346

FOREIGN PATENT DOCUMENTS

JP 52-36239 8/1977
JP 54-130613 9/1979

* cited by examiner

*Primary Examiner* — Hien Vu
(74) *Attorney, Agent, or Firm* — Flynn, Thiel, Boutell & Tanis, P.C.

(57) ABSTRACT

A connector 10 is made of a socket 20, a plug 30, and a removal prevention mechanism 40. The removal prevention mechanism 40 includes a slider tube 41 slidably mounted on a first body 21, a stop ring 42 mounted on the outer circumferential surface of the first body 21, a helical spring 43 resiliently disposed between the slider tube 41 and a socket member 22, a ball 44 movably mounted in a through hole 41C defined in the slider tube 41, a cavity 45 defined in the outer circumferential surface of the first body 21 for the ball 44 to drop therein, and an engaging surface 46 defined in the inner circumferential surface of the plug member 32, for engaging the ball 44.

4 Claims, 5 Drawing Sheets

CONNECTOR

TECHNICAL FIELD

The present invention relates to a connector for connecting an electric device and a cable or a cable and a cable to each other, and more particularly to a connector including a highly safe removal prevention mechanism.

BACKGROUND ART

One conventional connector of the type described above which has widely been used in the art is illustrated in FIGS. 5(*a*) through 5(*c*) of the accompanying drawings. The conventional connector will be described below with reference to FIGS. 5(*a*) through 5(*c*). The conventional connector comprises a socket 1 shown in FIG. 5(*a*) and a plug 2 shown in FIG. 5(*b*). When the socket 1 and the plug 2 are connected to each other, they are combined with each other in a state shown in FIG. 5(*c*).

The socket 1 comprises a first body 1A which is made of plastics and has a cylindrical shape, a plurality of pin holes 1B extending through the first body 1A, a plurality of sheath-shaped connection terminals 1C covering the respective inner circumferential surfaces of the pin holes 1B, and a tubular socket member 1D housing the first body 1A therein. The connection terminals 1C are connected by respective lug terminals, not shown, to a cable 3 which is connected to an electric device. The plug 2 comprises a second body, not shown, which is made of plastics and has a cylindrical shape, a plurality of pins 2B extending through the second body and insertable respectively into the pin holes 1B, and a tubular plug member 2C housing the second body therein. The socket member 1D has a connecting end whose outside diameter slightly smaller than the inside diameter of a connecting end of the plug member 2C. When the socket member 1D is fitted in the plug member 2C, the socket 1 and the plug 2 are electrically connected to each other. Although not shown, the socket member 1D has a connecting portion with an axial key disposed on the outer circumferential surface thereof, and the plug member 2C has a connecting portion with a slot defined in the inner circumferential surface thereof in alignment with the key. When the socket 1 and the plug 2 are to be connected to each other, they are positioned with respect to each other by the key and the slot.

The connector has a lock mechanism 4 shown in FIGS. 5(*a*) through 5(*c*). As shown in FIGS. 5(*a*) through 5(*c*), the lock mechanism 4 comprises a pushbutton 4A mounted on a surface of the end of the socket member 1D and extending axially, a ridge 4B disposed on a surface of the pushbutton 4A extending toward the connecting end and integrally formed with the pushbutton 4A, a leaf spring 4C for resiliently biasing the pushbutton 4A, and an engagement groove 4D defined in the inner circumferential surface of the plug member 2C near the connecting end thereof.

For connecting the socket 1 and the plug 2 to each other, the key of the socket member 10 and the slot of the plug member 2C are aligned with each other, and then the connecting portion of the socket member 1D is inserted into the connecting portion of the plug member 2C. When the connecting portion of the socket member 1D is inserted into the connecting portion of the plug member 2C, the ridge 4B of the lock mechanism 4 is pushed radially inwardly against the resilient force of the leaf spring 4C. When the connecting portion of the socket member 1D reaches the end of its inserting stroke, the ridge 4B is fitted into the engagement groove 4D in the inner circumferential surface of the plug member 2C under the bias of the leaf spring 4C, as shown in FIG. 5(*c*), thereby locking the socket 1 and the plug 2 in a connected state. The socket 1 is now locked against removal from the plug 2. For disconnecting the socket 1 from the plug 2, the pushbutton 4A of the socket member 10 is pushed to displace the ridge 4B out of the engagement groove 4D. The socket 1 is then removed and hence disconnected from the plug 2.

DISCLOSURE OF THE INVENTION

Problems to be Solved by the Invention

The pushbutton 4A of the lock mechanism 4 projects from the surface of the socket member 1D. If the cable 3 is placed on the ground and so is the connector, then the user may inadvertently step on the connector, causing damage to the pushbutton 4A or forcibly removing and hence electrically disconnecting the plug 2 from the socket 1 thereby to turn off the electric device which has been operating. Alternatively, the user may inadvertently press the connector against an object or press the pushbutton 4A, tending to remove the plug 2 from the socket 1. In addition, the conventional connector is of a relatively high cost because it is made up of many parts including the lock mechanism 4, complex in structure, and assembled of individually manufactured parts.

Patent document 1 discloses a cable connector having a ball-type lock mechanism. However, no specific structural details of the lock mechanism are disclosed. Patent document 2 discloses a lock mechanism for an optical connector. The lock mechanism includes lock levers as main components which are resiliently swingable. The lock levers have respective teeth for engaging lock members of a companion component, for thereby locking the companion component. The lock mechanism is large in size because of its structure and is not suitable for use in small connectors.

Patent document 1: Japanese Patent No. 2972733

Patent document 2: Japanese utility model publication No. 5-22885

The present invention has been made in order to solve the above problems. It is an object of the present invention to provide a connector which is rugged and will not be broken when stepped on, prevents a socket from being removed and disconnected from a plug when subjected to accidental forces or inadvertently pressed, is simple in structure, and can be manufactured at a low cost.

Means for Solving the Problems

According to claim 1 of the present invention, a connector comprises a socket having a pin hole, a plug having a pin for insertion into the pin for electric connection thereto, and a removal prevention mechanism for preventing the socket and the plug from being removed from each other, the socket including a first body made of plastics and having the pin hole and a socket member covering the outer circumferential surface of a proximal end portion of the first body and integrally combined with the first body, the plug including a second body made of plastics which is integrally combined with the pin and a plug member covering the outer circumferential surface of the second body and integrally combined with the second body, the plug member having a space surrounding the pin which projects from the second body, wherein the first body of the socket and the plug member fit with each other to insert the pin into the pin hole, thereby connecting the socket and the plug to each other, and the removal prevention mechanism securely keeps the socket and the plug connected to each other, and the removal prevention mechanism including a slider slidably mounted on an outer surface of the first body except the proximal end portion thereof, a stop ring mounted on the outer circumferential surface of a distal end of the first body, for preventing the slider from being removed from the first body, a spring resiliently disposed between the slider and the socket member, for resiliently biasing the slider against the stop ring, a ball movably mounted in a hole defined in the slider against displacement out of the hole, a cavity defined in an outer circumferential surface of the first body for the ball to be retracted therein from an outer surface of the slider when the slider moves along the outer surface of the first body toward the socket member against the bias of the spring and the ball in the hole reaches the cavity, and an engaging surface defined in an inner circumferential surface of the plug member for engaging the ball which projects from the outer surface of the slider when the first body and the plug member fit with each other.

According to claim 2 of the present invention, in the invention recited in claim 1, the slider is of a tubular shape covering the first body.

According to claim 3 of the present invention, in the invention recited in claim 1 or 2, the first body has an axial guide key disposed on the surface thereof, and the slider has an axial slot defined in an inner surface of the slider for the guide key to engage therein, and wherein when the slider moves along the first body while being guided by the slot and the guide key, the ball is guided into the cavity.

According to claim 4 of the present invention, in the invention recited in any one of claims 1 through 3, the first body is integrally combined with the socket member and the second body is integrally combined with the plug member.

Advantages of the Invention

According to the present invention, there is provided a connector which is simple in structure, is made up of a reduced number of parts, can be manufactured at a low cost, is rugged and will not be broken when stepped on, and prevents a socket from being removed and disconnected from a plug when subjected to accidental forces or inadvertently pressed.

BEST MODE FOR CARRYING OUT THE INVENTION

Figure 1:
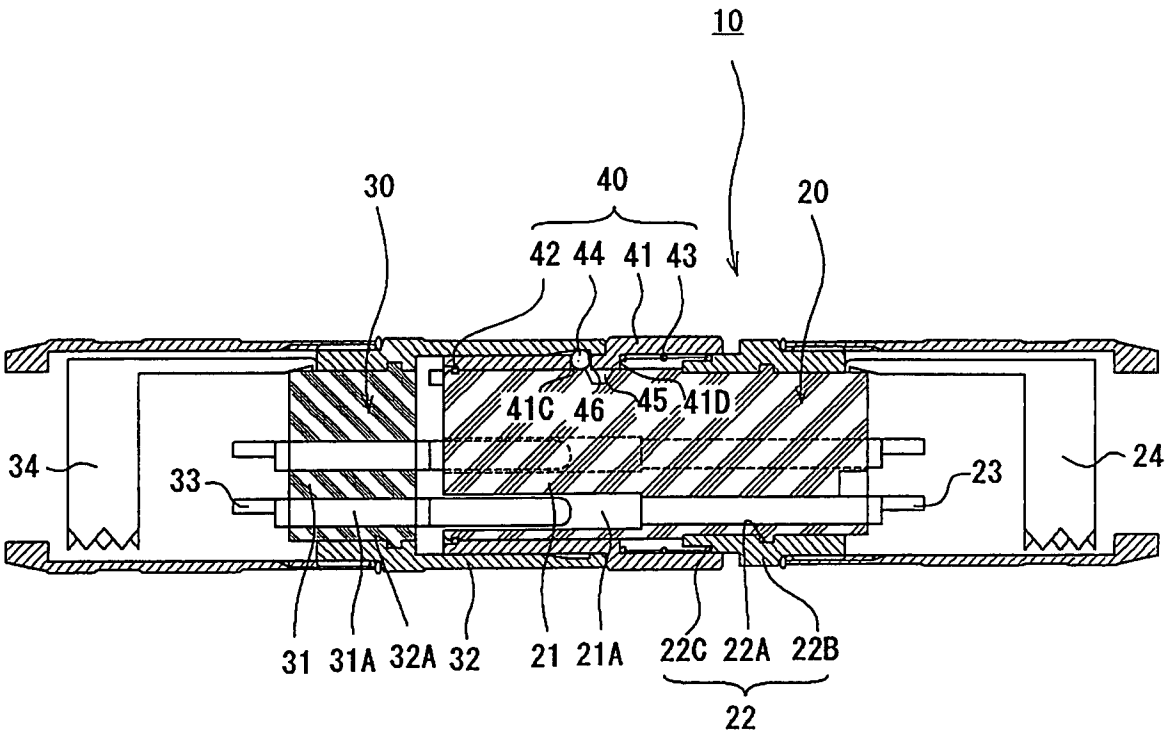
FIG. 1 is an axial cross-sectional view of a connector according to an embodiment of the present invention.

A connector according to an embodiment of the present invention will be described below with reference to FIGS. 1 through 4(*a*) through (*c*). In the drawings, FIG. 1 is an axial cross-sectional view of a connector according to an embodiment of the present invention, FIGS. 2(*a*) through 2(*c*) are views showing a socket of the connector shown in FIG. 1, FIG. 2(*a*) being a side elevational view showing main parts of the socket, FIG. 2(*b*) a cross-sectional view taken along line B-B of FIG. 2(*a*), and FIG. 2(*c*) a cross-sectional view taken along line C-C of FIG. 2(*a*), FIGS. 3(*a*) and 3(*b*) are views showing a plug of the connector shown in FIG. 1, FIG. 3(*a*) being a cross-sectional view of the plug and FIG. 3(*b*) a cross-sectional view taken along line B-B of FIG. 3(*a*), and FIGS. 4(*a*) through 4(*c*) are views showing a slider of a removal prevention mechanism of the connector shown in FIG. 1, FIG. 4(*a*) being a side elevational view of the slider, FIG. 4(*b*) an axial cross-sectional view of the slider, and FIG. 4(*c*) a cross-sectional view taken along line C-C of FIG. 4(*a*).

A connector 10 according to the present embodiment comprises a socket 20 having pin holes, a plug 30 having pins for being inserted into the respective pin holes for electric connection therewith, and a removal prevention mechanism 40 for preventing the socket 10 and the plug 20 from being removed from each other.

As shown in FIG. 1, the socket 20 includes a first body 21 made of plastics which has a plurality of (three in the illustrated embodiment) pin holes 21A defined therein and a distal end portion serving as a connecting portion for connection to the plug 30, and a tubular socket member 22 made of metal which is integrally combined with a proximal end portion of the first body 21. The connecting portion of the first body 21 is exposed from the socket member 22. The removal prevention mechanism 40 includes a tubular slider (hereinafter referred to as "slider tube"), to be described later, mounted on and covering the connecting portion of the first body 21. The pin holes 21A extend axially through the first body 21 and have respective inner circumferential surfaces covered with respective sheath-shaped conductive terminals, not shown. The conductive terminals are integral with respective connecting pins 23 which project from the end (hereinafter referred to as "non-connecting end") of the first body 21 remote from the connecting portion thereof. A cable, not shown, is connected to the connecting pins 23. A lug terminal 24 serving as a ground terminal is mounted on the non-connecting end of the first body 21. The lug terminal 24 has a function to secure the cable connected to the connecting pins 23 by crimping.

The socket member 22 has an annular groove 22A defined axially centrally in the inner circumferential surface thereof. The annular groove 22A may be replaced with circumferentially discrete grooves. When the first body 21 is molded of plastics, the molten plastics flows into the annular groove 22A, forming a flange around the first body 21. The flange serves to prevent the first body 21 from being dislodged from the socket member 22. Since the first body 21 is thus integrally combined with the socket member 22, the conductive terminals, the connecting pins 23, and the lug terminal 24, the cable can simply be connected to the connecting pins 23. The conventional connector has required a complex process and many man-hours to connect the cable to the socket because the socket has been assembled of individually manufactured parts. The socket 20 and also the plug 30, to described later, according to the present embodiment are free of such difficulties.

Figure 2:
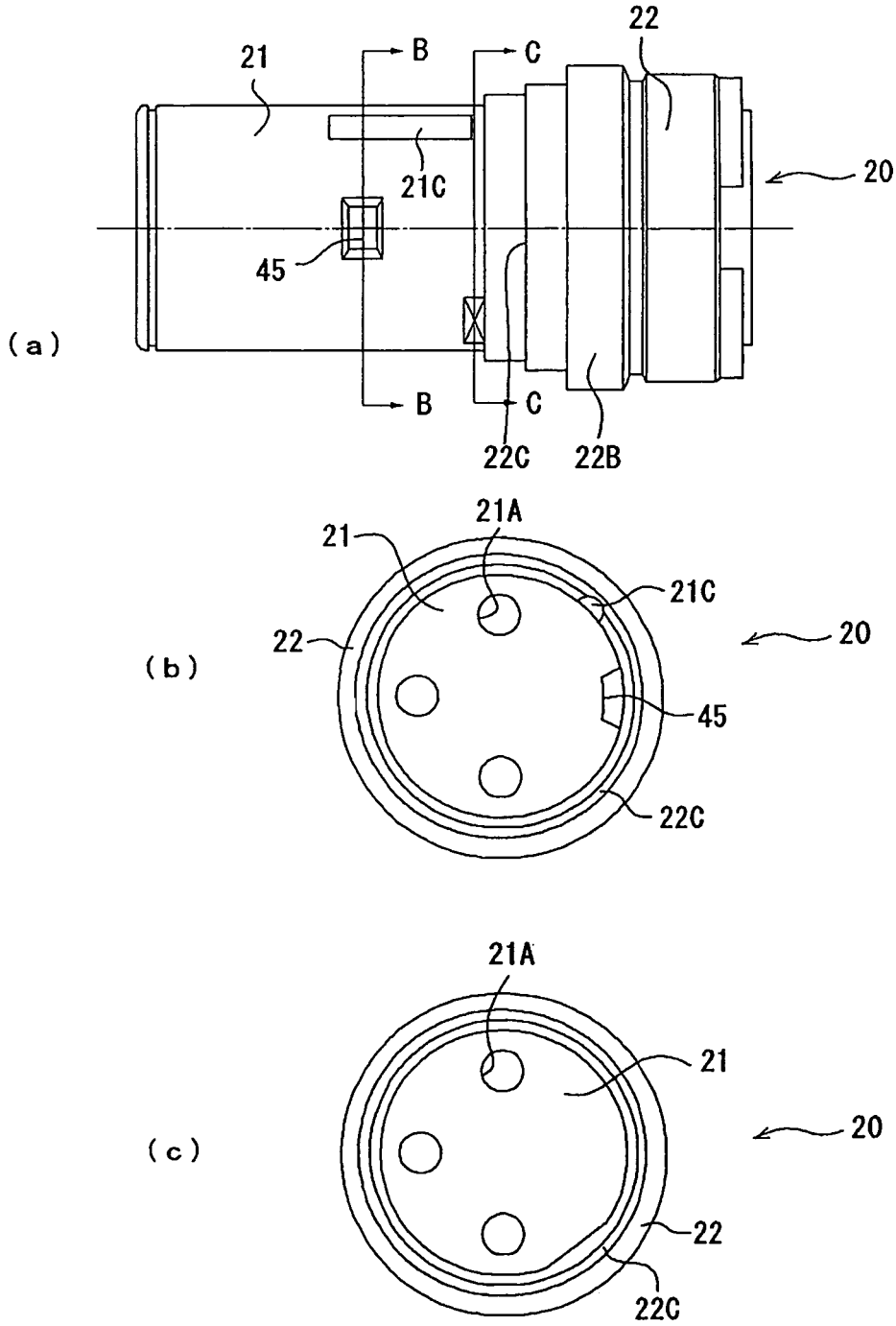
FIGS. 2(*a*) through 2(*c*) are views showing a socket of the connector shown in FIG. 1, FIG. 2(*a*) being a side elevational view showing main parts of the socket, FIG. 2(*b*) a cross-sectional view taken along line B-B of FIG. 2(*a*), and FIG. 2(*c*) a cross-sectional view taken along line C-C of FIG. 2(*a*)

As shown in FIGS. 2(*a*) through 2(*c*), the first body 21 has an axial guide key 21C disposed on the outer circumferential surface thereof near the socket member 22. The guide key 21C engages in an axial guide slot defined in the slider tube of the removal prevention mechanism 40 for allowing the slider tube to move axially, but nonrotatably, straight along the first body 21.

Figure 3:
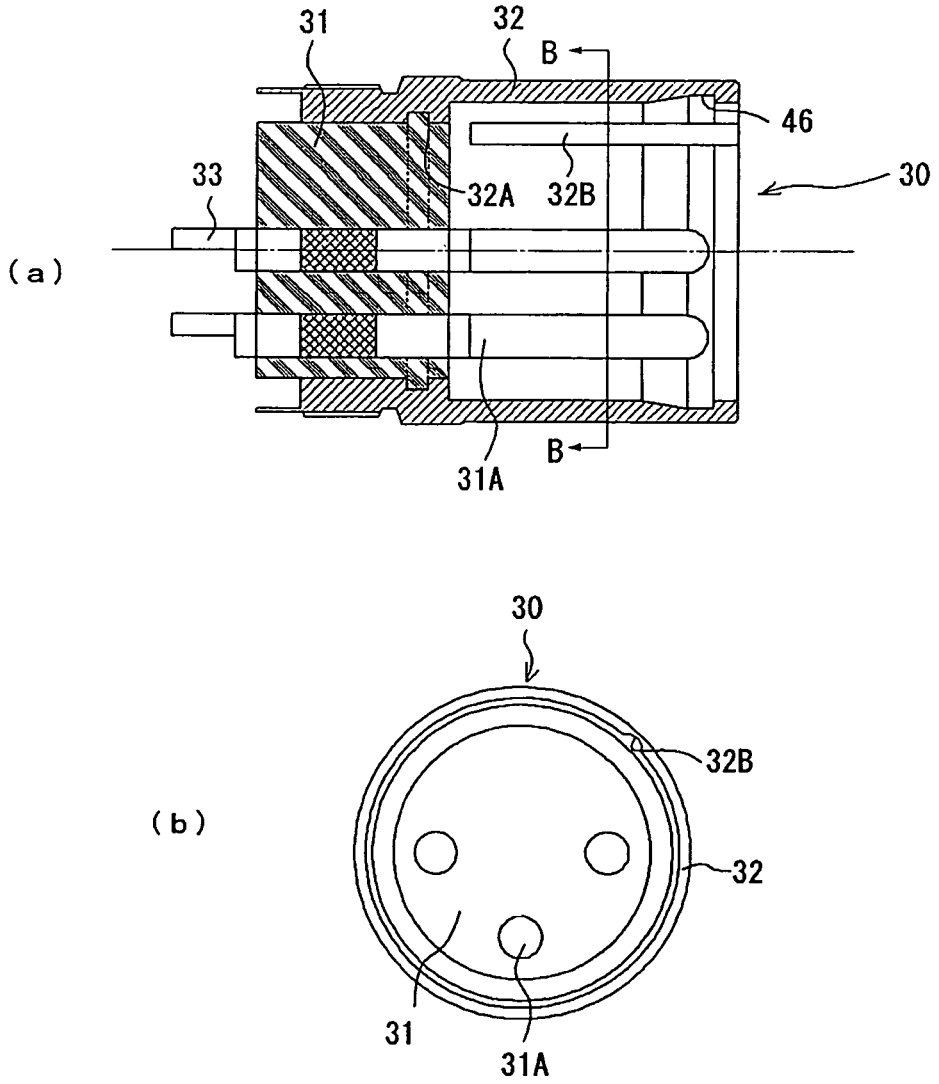
FIGS. 3(*a*) and 3(*b*) are views showing a plug of the connector shown in FIG. 1, FIG. 3(*a*) being a cross-sectional view of the plug and FIG. 3(*b*) a cross-sectional view taken along line B-B of FIG. 3(*a*)

As shown in FIG. 1, the plug 30 comprises a second body 31 made of plastics having a plurality of (three in the illustrated embodiment) pins 31A integrally combined therewith, and a tubular plug member 32 made of metal which integrally houses the second body 31 therein. The second body 31 is integrally combined with a proximal end portion of the plug member 32. As shown in FIGS. 1 and 3(*a*), the plug member 32 has an annular groove 32A defined in the inner circumferential surface of the proximal end portion thereof. The annular groove 32A may be replaced with circumferentially discrete grooves. When the second body 31 is molded of plastics, the molten plastics flows into the annular groove 32A, forming a flange around the second body 11. The flange serves to prevent the second body 31 from being dislodged from the plug member 32. The plug member 32 has a connecting portion for connection to the socket 20, where the pins 31A project from an end face of the second body 31. The three pins 31A extend through the second body 31 and are connected to connecting pins 33 projecting from the end face of a non-connecting portion of the second body 31. A cable, not shown, is connected to the connecting pins 33. A lug terminal 34 serving as a ground terminal is mounted on the non-connecting end of the second body 31. The lug terminal 34 has a function to secure the cable connected to the connecting pins 33 by crimping. The connecting portion of the plug member 32 has a guide key and an engaging surface, to be described later, defined in the inner circumferential surface thereof.

The connector 10 is joined together when the connecting portion of the first body 21 of the socket 20 is inserted into the connecting portion of the plug member 32 of the plug 30. According to the present embodiment, the connector 10 includes the removal prevention mechanism 40 which locks the socket 20 and the plug 30 together against removal from each other. The removal prevention mechanism 40 will be described in detail below with reference to FIGS. 1 through 4(*c*).

As shown in FIG. 1, the removal prevention mechanism 40 includes a slider tube 41 which is slidably mounted on the connecting portion of the first body 21 of the socket 20, a stop ring 42 mounted in an annular groove defined in the outer circumferential surface of the distal end of the connecting portion of the first body 21, for preventing the slider tube 41 from being removed from the first body 21, and a helical spring 43 resiliently disposed between the slider tube 41 and the socket member 22, for resiliently biasing the slider tube 41 against the stop ring 42. The slider tube 41 has an outside diameter slightly smaller than the inside diameter of the connecting portion of the plug member 32. Therefore, the connecting portion of the socket 20 for connection to the plug 30 is constructed of the first body 21 and the slider tube 41 covering the first body 21.

Figure 4:
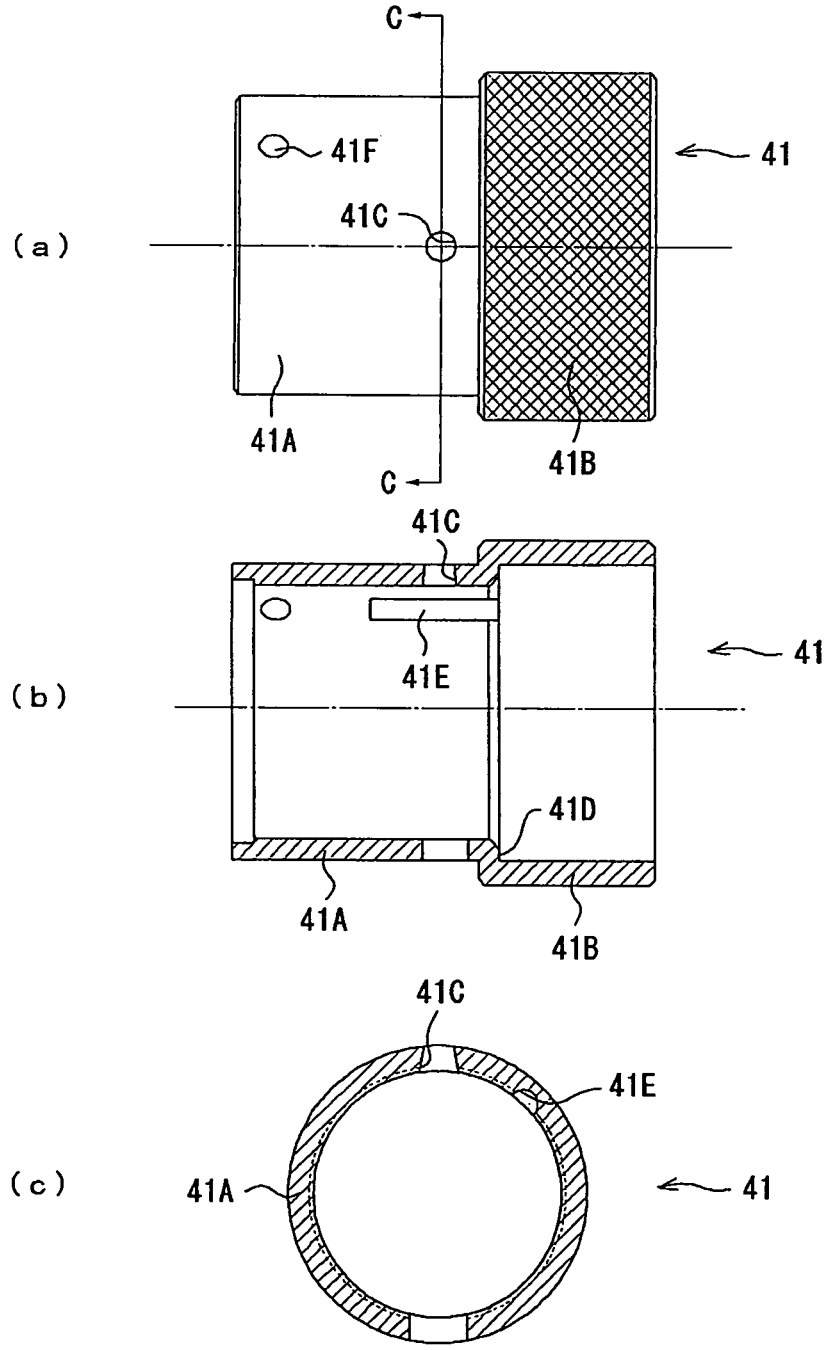
FIGS. 4(*a*) through 4(*c*) are views showing a slider of a removal prevention mechanism of the connector shown in FIG. 1, FIG. 4(*a*) being a side elevational view of the slider, FIG. 4(*b*) an axial cross-sectional view of the slider, and FIG. 4(*c*) a cross-sectional view taken along line C-C of FIG. 4(*a*)
Figure 5:
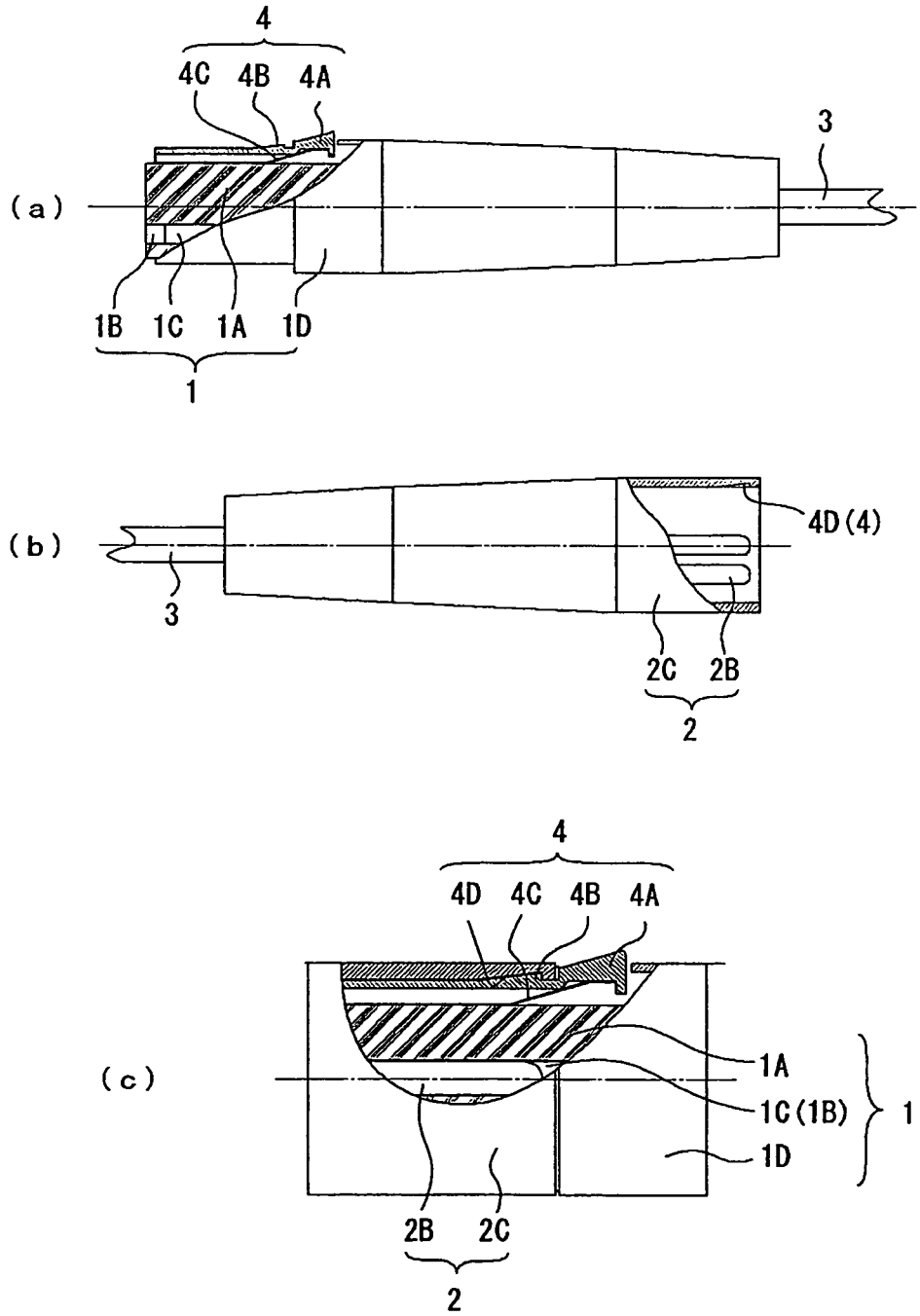
FIGS. 5(*a*) through 5(*c*) are views showing a conventional connector, FIG. 5(*a*) being a side elevational view, partly cut away, of a socket of the conventional connector, FIG. 5(*b*) a side elevational view, partly cut away, of a plug of the conventional connector, and FIG. 5(*c*) a fragmentary side elevational view, partly cut away, of the socket and the plug which are connected to each other.

As shown in FIGS. 4(*a*) and 4(*b*), the slider tube 41 comprises a smaller-diameter portion 41A slidably mounted on the first body 21 and a larger-diameter portion 41B enlarged in diameter from an end of the smaller-diameter portion 41A which is near the socket member 22. The smaller-diameter portion 41A has a through hole 41C defined therein. The through hole 41C is defined by a tapered inner side wall which is progressively smaller in diameter from the inner circumferential surface of the slider tube 41 toward the outer circumferential surface thereof. As shown in FIG. 1, a ball 44 is retained in the through hole 41C against displacement radially outwardly from the slider tube 41, but partly projects from the outer circumferential surface thereof. As shown in FIGS. 1, 2(*a*) and 2(*b*), the first body 21 of the socket 20 has a cavity 45 defined in the outer circumferential surface thereof for receiving therein the ball 44 that is retained in the through hole 41C of the slider tube 41.

As shown in FIGS. 1 and 2(*a*), the socket member 22 has an annular ridge 22B disposed centrally on the outer circumferential surface thereof adjacent to the slider tube 41. The annular ridge 22B has an outside diameter which is substantially the same as the outside diameter of the larger-diameter portion 41B of the slider tube 41. As shown in FIG. 1, the connecting portion of the plug member 32 has an inside diameter large enough for the smaller-diameter portion 41A of the slider tube 41 to be inserted therein, and an outside diameter which is substantially the same as the outside diameter of the larger-diameter portion 41B of the slider tube 41.

The inside of the plug member 32 serves as a space for connection to the smaller-diameter portion 41A of the slider tube 41. When the socket 20 and the plug 30 are connected to each other, as shown in FIG. 1, the distal end face of the plug member 32 abuts against the outer step of the larger-diameter portion 41B of the slider tube 41, leaving a gap between the first body 21 and the second body 31.

As shown in FIG. 1, the socket member 22 includes a thin-walled portion on its end near the slider tube 41. As shown in FIGS. 1, 2(*a*) through 2(*c*), the socket member 22 has a step 22C at the end of the thin-walled portion near the annular ridge 22B. As shown in FIG. 1, the larger-diameter portion 41B of the slider tube 41 is of a size large enough to cover the socket member 22, with a clearance left between the inner circumferential surface of the larger-diameter portion 41B and the outer circumferential surface of the thin-walled portion of the socket member 22. The helical spring 43 is resiliently held between a step 41D where the larger-diameter portion 41B is enlarged in diameter from the smaller-diameter portion 41A and the step 22C at the end of the thin-walled portion of the socket member 22. The slider tube 41 is resiliently held against the stop ring 42 under the bias of the helical spring 43. The helical spring 43 has a right end fitted in the clearance between the outer circumferential surface of the thin-walled portion of the socket member 22 and the inner circumferential surface of the larger-diameter portion 41B of the slider tube 41. With the slider tube 41 resiliently held against the stop spring 42, the axial gap between the end face of the larger-diameter portion 41B of the slider tube 41 and the end face of the annular ridge 22B of the socket member 22 serves as a range in which the slider tube 41 is movable.

As shown in FIG. 4(*b*), the smaller-diameter portion 41A of the slider tube 41 has a straight slot 41E defined in the inner circumferential surface thereof for the guide key 21C of the first body 21 to fit therein. The straight slot 41E extends axially from the end of the smaller-diameter portion 41A near the socket member 21, and the slider tube 41 moves straight along the guide key 21C. As shown in FIGS. 4(*a*) and 4(*b*), the smaller-diameter portion 41A also has a spherical protrusion 41F on the outer circumferential surface thereof at a position which is spaced a certain distance from the far end of the straight slot 41E. As shown in FIG. 4(*a*), the protrusion 41F is angularly spaced circumferentially from the through hole 41C by a certain angle and positioned near the connecting end thereof.

As shown in FIGS. 3(*a*) and 3(*b*), the plug member 32 has an axial guide slot 32B defined in the inner circumferential surface thereof in alignment with the protrusion 41F of the slider tube 41. The guide slot 32B is defined as a recess of semicircular cross section at the end face of the plug member 32 near the socket 20. The recess at the end face has a function to position the protrusion 41F of the slider tube 41. When the socket 20 is to be connected to the plug 30, the protrusion 41F of the slider tube 41 is aligned with the recess of the guide slot 32B, and then the socket 20 is pushed toward the plug 30. The socket 20 is now connected to the plug 30 against removal therefrom.

As shown in FIG. 3(*a*), the inner circumferential surface of the connecting portion of the plug member 32 has a tapered surface whose diameter is progressively greater. A step which extends perpendicularly to the axis at the position where the tapered surface has the maximum diameter serves as an engaging surface 46. The ball 44 which projects from the through hole 41C of the slider tube 41 engages the engaging surface 46 (see FIG. 1). When the ball 44 engages the engaging surface 46, the socket 20 is securely connected to the plug 30 against removal therefrom. For disconnecting the socket 20 from the plug 30, the slider tube 41 is slid until it abuts against the annular ridge 22B of the socket member 22 against the bias of the helical spring 43. As the slider tube 41 is thus slid, the ball 44 moves with the plug 30 toward the socket member 22 and drops into the cavity 45 of the first body 21. The ball 44 now disengages from the engaging surface 46, allowing the socket 20 to be removed and disconnected from the plug 30.

A process of joining the connector 10 will be described below. For using the connector 10, the connecting portion of the socket 20 and the connecting portion of the plug 30 are positioned in confronting relation to each other, and the protrusion 41F of the slider tube 41 is aligned with the recess of the guide key 32B of the plug member 32. Then, the connecting portion of the socket 20 is inserted into the plug member 32 until the end face of the plug member 32 abuts against the larger-diameter portion 41B of the slider tube 41. Thereafter, the slider tube 41 is slid toward the socket member 22 against the bias of the helical spring 43.

At this time, since the straight slot 41 of the slider tube 41 receives therein the guide key 21C of the first body 21, the slider tube 41 moves straight along the guide key 21C until it abuts against the annular ridge 22B of the socket member 22. The ball 44 now fits into the cavity 45 of the first body 21, and the connecting portion of the socket 20 moves straight on deeply into the plug member 32. The instant the end face of the plug member 32 abuts against the annular ridge 22B and the ball 44 reaches the engaging surface 46 of the plug member 32, the helical spring 43 acts to separate the socket 20 and the plug 30 slightly from each other, causing the ball 44 to move from the cavity 45 onto the outer circumferential surface of the first body 21 into engagement with the engaging surface 46. The socket 20 and the plug 30 are now securely held in a connected state. At this time, the pins 31A of the plug 30 have been inserted in and electrically connected to the pin holes 21A of the socket 20.

For disconnecting the socket 20 and the plug 30 from each other, the slider tube 41 is moved straight in unison with the plug 30 until it abuts against the annular ridge 22B of the socket member 22. The slider tube 41 carries the ball 44 from the outer circumferential surface of the first body 21 to the cavity 45, whereupon the ball 44 drops into the cavity 45. The ball 44 disengages from the engaging surface 46, allowing the socket 20 to be removed from the plug 30.

Once the socket 20 and the plug 30 are connected to each other as described above, they cannot be disconnected from each other unless the slider tube 41 is slid on the first body 21. Therefore, the connector 10 will not be disconnected when subjected to accidental forces or inadvertently pressed at the time the user steps on the connector 10. Since the removal prevention mechanism 40 is of a rugged structure because of the slider tube 41, the ball 44, and the engaging surface 46 in the inner circumferential surface of the plug member 32, the removal prevention mechanism 40 will not be damaged when the user steps on the connector 10.

The ball 44 of the removal prevention mechanism 40 and the positioning protrusion 41F are positionally identical to those of the conventional socket. Therefore, the socket 20 according to the present embodiment is compatible with the conventional socket as the engaging surface of the conventional socket can be used as the engaging surface for engaging the ball 44.

According to the present embodiment, as described above, the removal prevention mechanism 40 for preventing the socket 20 and the plug 30 from being removed from each other comprises the slider tube 41 slidably mounted on the connecting portion of the first body 21, the stop ring 42 mounted on the outer circumferential surface of the distal end of the connecting portion of the first body 21, for preventing the slider tube 41 from being removed from the first body 21, the helical spring 43 resiliently disposed between the slider tube 41 and the socket member 22, for resiliently biasing the slider tube 41 against the stop ring 42, the ball 44 movably mounted in the through hole 41C against displacement out of the through hole 41C, the cavity 45 defined in the outer circumferential surface of the first body 21 for the ball 44 to be retracted therein from the outer circumferential surface of the slider tube 41 when the slider tube 41 moves toward the socket member 22 against the bias of the helical spring 43, and the engaging surface 46 defined in the inner circumferential surface of the plug member 32 for engaging the ball 44 which projects from the outer circumferential surface of the first body 21 when the first body 21 and the plug member 32 fit with each other. Simply when the connecting portion of the socket 20 is inserted into the connecting portion of the plug 30, the socket 20 and the plug 30 are automatically connected to each other, and the socket 20 is automatically prevented from being removed from the plug 30. The connector 10 is rugged and will not be broken when it is stepped on, and is free of dangers when subjected to accidental forces or inadvertently pressed. The connector 10 is reliably held in the connected state at all times, is of a simple structured, and can be manufactured at a low cost.

According to the present embodiment, furthermore, the first body 21 has the axial guide key 21C disposed on the outer surface thereof, and the slider tube 41 has the axial straight slot 41E defined in the inner surface thereof for engagement with the guide key 21C. When the slider tube 41 moves along the first body 21 while being guided by the straight slot 41E and the guide key 21C, the ball 44 is guided into the cavity 45. When the socket 20 and the plug 30 are to be connected to each other, the slider tube 41 is reliably moved straight axially on the first body 21, guiding the ball 44 into the cavity 45 to reliably prevent the socket 20 and the plug 30 from being removed from each other. As the first body 21 is integrally combined with the socket member 22 and the second body 31 is integrally combined with the plug member 32, it is possible to reduce the number of man-hours required to assemble individual parts, which is large with the conventional connector, and to connect the cables easily with each other. The socket 20 is highly versatile and economical because it is compatible with the conventional socket.

The present invention is not limited to the above embodiment. If necessary, the components of the connector can be changed in design. For example, although the slider tube 41 has been described by way of example as a slider in the above embodiment, the first body may have an axial guide slot defined in the outer circumferential surface thereof, and the slider may slid in the guide slot. The engaging surface is provided as the tapered surface extending fully around the inner circumferential surface of the plug member in the above embodiment. However, the engaging surface may be provided in a portion which is aligned with the ball of the slider. Although the tubular connector has been described above in the above embodiment, the present invention is also applicable to a rectangular connector.

INDUSTRIAL APPLICABILITY

The present invention is applicable to a connector for connecting an electric device and a cable or a cable and a cable to each other.

DESCRIPTION OF REFERENCE CHARACTERS

10 connector
20 socket
21 first body
21A pin hole
21C guide key
22 socket member
30 plug
31 second body
31A pin
32 plug body
40 removal prevention mechanism
41 slider tube (slider)
41C through hole (hole)
41E straight slot (slot)
42 stop ring
43 helical spring (spring)
44 ball
45 cavity
46 engaging surface

The invention claimed is:

1. A connector comprising a socket having a pin hole, a plug having a pin for insertion into said pin hole for electric connection thereto, and a removal prevention mechanism for preventing said socket and said plug from being removed from each other, said socket including a first body made of plastics and having said pin hole and a socket member covering the outer circumferential surface of a proximal end portion of said first body and integrally combined with said first body, said plug including a second body made of plastics which is integrally combined with said pin and a plug member covering the outer circumferential surface of said second body and integrally combined with said second body, said plug member having a space surrounding the pin which projects from said second body, wherein said first body of said socket and said plug member fit with each other to insert said pin into said pin hole, thereby connecting said socket and said plug to each other, and said removal prevention mechanism securely keeps said socket and said plug connected to each other, and said removal prevention mechanism including a slider slidably mounted on an outer surface of said first body except the proximal end portion thereof, a stop ring mounted on the outer circumferential surface of a distal end of said first body, for preventing said slider from being removed from said first body, a spring resiliently disposed between said slider and said socket member, for resiliently biasing said slider against said stop ring, a ball movably mounted in a hole defined in said slider against displacement out of said hole, a cavity defined in an outer circumferential surface of said first body for said ball to be retracted therein from an outer surface of said slider when said slider moves along the outer surface of said first body toward said socket member against the bias of said spring and said ball in said hole reaches said cavity, and an engaging surface defined in an inner circumferential surface of said plug member for engaging said ball which projects from the outer surface of said slider when said first body and said slider fit into said plug member.

2. A connector according to claim 1, wherein said slider is of a tubular shape covering said first body.

3. A connector according to claim 1, wherein said first body has an axial guide key disposed on the surface thereof, and said slider has an axial slot defined in an inner surface of said slider for said guide key to engage therein, and wherein when said slider moves along said first body while being guided by said slot and said guide key, said ball is guided into said cavity.

4. A connector according to claim 1, wherein said first body is integrally combined with said socket member and said second body is integrally combined with said plug member.

* * * * *